US012663240B2

(12) United States Patent
Zaremba

(10) Patent No.: US 12,663,240 B2
(45) Date of Patent: Jun. 23, 2026

(54) MODULAR BODY HARNESS

(71) Applicant: James Zaremba, Vero Beach, FL (US)

(72) Inventor: James Zaremba, Vero Beach, FL (US)

( * ) Notice: Subject to any disclaimer, the term of this patent is extended or adjusted under 35 U.S.C. 154(b) by 110 days.

(21) Appl. No.: 18/826,430

(22) Filed: Sep. 6, 2024

(65) Prior Publication Data

US 2026/0071848 A1 Mar. 12, 2026

(51) Int. Cl.
*F41H 1/02* (2006.01)
*A41D 13/00* (2006.01)

(52) U.S. Cl.
CPC ..... *F41H 1/02* (2013.01); *A41D 13/0012* (2013.01)

(58) Field of Classification Search
CPC ... F41H 1/02; F41H 5/013; F41H 5/08; F41H 1/00; F41H 5/0492; A41D 13/0012; A41D 13/0568; A41D 13/05; A41D 13/0518; A41D 13/055; A41D 13/0562; A41D 13/0575; A45F 2003/003; B32B 2571/02
USPC ..... 224/576
See application file for complete search history.

(56) References Cited

U.S. PATENT DOCUMENTS

| | | | | |
|---|---|---|---|---|
| 8,365,312 | B2 * | 2/2013 | Herring | A41D 13/0007 2/2.5 |
| 11,033,095 | B1 * | 6/2021 | VanHeusen | A45F 5/00 |
| 11,533,984 | B2 * | 12/2022 | Duncan | A45C 3/001 |
| 12,385,726 | B2 * | 8/2025 | Cragg | F42B 39/02 |
| 2005/0005343 | A1 * | 1/2005 | Johnson | F41H 1/02 2/102 |
| 2014/0201879 | A1 * | 7/2014 | Seuk | F41H 1/02 2/2.5 |
| 2016/0128394 | A1 * | 5/2016 | Kohrman | A45F 3/14 2/102 |

* cited by examiner

*Primary Examiner* — Adam J Waggenspack
(74) *Attorney, Agent, or Firm* — The Rapacke Law Group, P.A.; Andrew S. Rapacke; Kenneth F. Brooks

(57) ABSTRACT

A modular body harness is disclosed, including a sheet including a plurality of slots. A first set of hook and loop strips are positioned horizontally at a bottom portion of the sheet and a second set of hook and loop strips are positioned vertically above the first set of hook and loop strips. A plurality of self-gripping hook and loop strips are each engaged with one of the plurality of slots and attached to themselves. A parachute cord extends through a portion of the plurality of self-gripping hook and loop strips.

20 Claims, 7 Drawing Sheets

MODULAR BODY HARNESS

TECHNICAL FIELD

The embodiments generally relate to tactical equipment and more specifically to a modular body harness.

BACKGROUND

Previous equipment such as plate carriers, chest rigs, reconnaissance chest rigs, and load-bearing vests were built with a single purpose and are seldom interchangeable and their customizability is limited at best. During tactical training, law enforcement, or military operations individuals wear chest rigs that carry ammunition and equipment but offer no ballistic protection. While conducting operations or training individuals may need ballistic protection at a moment's notice but are limited to full-size plater carriers or ballistic-proof vests which are both expensive and bulky.

SUMMARY OF THE INVENTION

This summary is provided to introduce a variety of concepts in a simplified form that is further disclosed in the detailed description of the embodiments. This summary is not intended for determining the scope of the claimed subject matter.

The embodiments provided herein disclose a modular body harness is disclosed, including a sheet including a plurality of slots. A first set of hook and loop strips are positioned horizontally at a bottom portion of the sheet and a second set of hook and loop strips are positioned vertically above the first set of hook and loop strips. A plurality of self-gripping hook and loop strips are each engaged with one of the plurality of slots and attached to themselves. A parachute cord extends through a portion of the plurality of self-gripping hook and loop strips.

In some aspects, the sheet is constructed of acrylic polyvinyl chloride and has a polygonal shape (e.g., a hexagon).

In some aspects, the parachute cord enables the input of a body armor plate to be retained between the parachute cord and the sheet.

In some aspects, the first set of hook and loop strips include a top strip and bottom strip.

In some aspects, the second set of hook and loop strips include a left strip and a right strip.

In some aspects, the modular body harness is used as a plate carrier via the attachment of the modular body harness to a chest rig.

In some aspects, the sheet is attached to the chest rig via the first set of hook and loop strips and the second set of hook and loop strips.

In some aspects, the self-gripping hook and loop strips are adjustable to secure the body armor plate to the sheet.

This modular body harness gives the user the ability to modify their equipment to their exact need and specifications while still having the ability to change whenever they see fit. The invention's cost is a fraction of the price of the items listed above but gives the user a long list of use options. In one aspect, the switch is in electrical communication with the gear motor and the slip-clutch to enable the operator to selectively open and selectively close the discharge blocker plate.

Unlike currently available equipment such as plate carriers, chest rigs, reconnaissance chest rigs, and load-bearing chest rigs, which are designed for a single purpose and are rarely interchangeable, the modular body harness described herein allows users to modify their gear to their preferred specifications for each specific task. Further, the modular body harness is significantly more affordable than traditional gear used in the industry.

Other illustrative variations within the scope of the invention will become apparent from the detailed description provided hereinafter. The detailed description and enumerated variations, while disclosing optional variations, are intended for purposes of illustration only and are not intended to limit the scope of the invention.

BRIEF DESCRIPTION OF THE DRAWINGS

A complete understanding of the present embodiments and the advantages and features thereof will be more readily understood by reference to the following detailed description when considered in conjunction with the accompanying drawings wherein.

DETAILED DESCRIPTION

Figure 1:
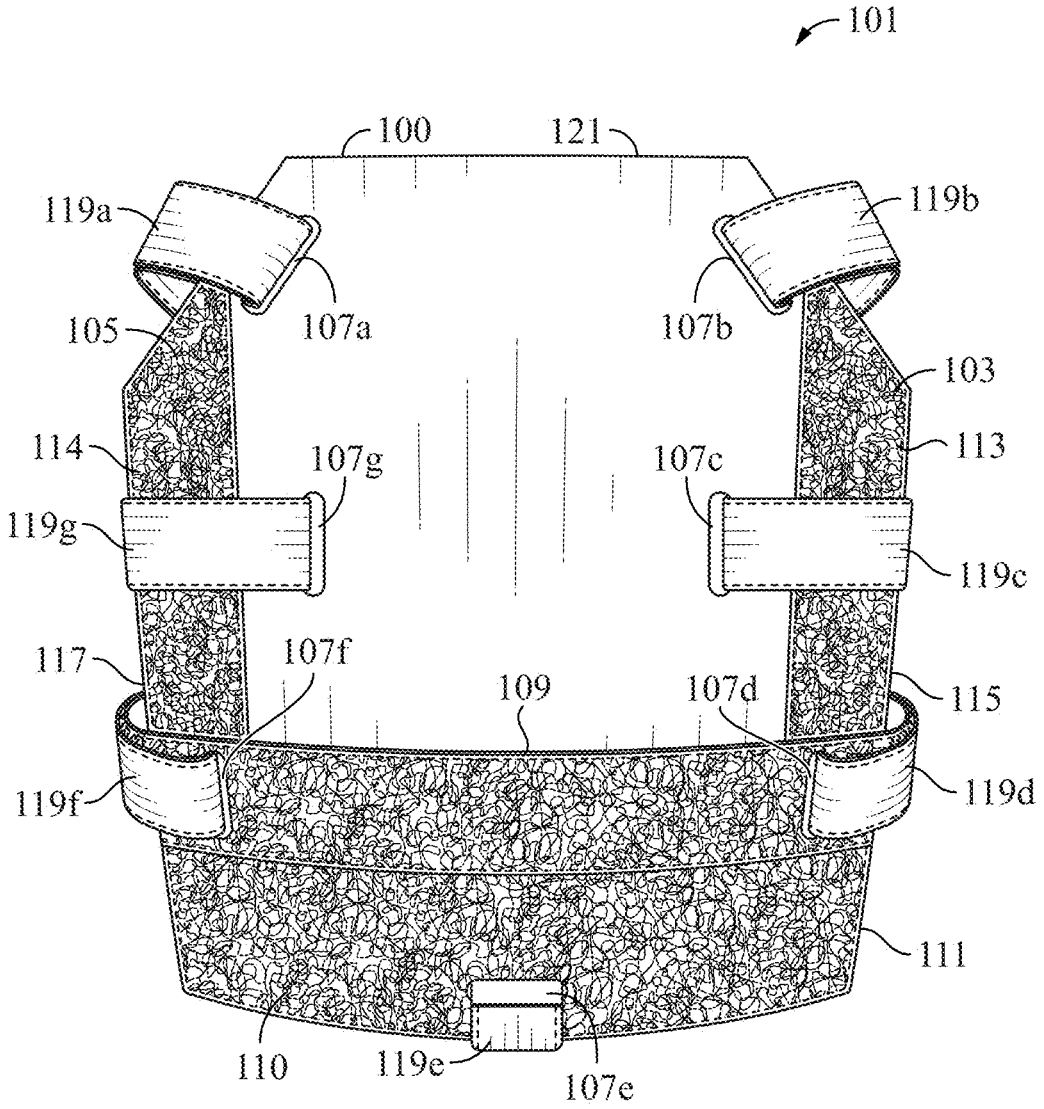
FIG. 1 illustrates a perspective view of the front side of the modular body harness, according to some embodiments.

The specific details of the single embodiment or variety of embodiments described herein are set forth in this application. Any specific details of the embodiments described herein are used for demonstration purposes only, and no unnecessary limitation(s) or inference(s) are to be understood or imputed therefrom.

Before describing in detail exemplary embodiments, it is noted that the embodiments reside primarily in combinations of components related to particular devices and systems. Accordingly, the device components have been represented where appropriate by conventional symbols in the drawings, showing only those specific details that are pertinent to understanding the embodiments of the present disclosure so as not to obscure the disclosure with details that will be readily apparent to those of ordinary skill in the art having the benefit of the description herein.

In general, the embodiments provided herein relate to modular body harness which can be used independently or in conjunction with a chest rig. The modular body harness enables the user to easily and efficiently attach armor plates to their chest rig as needed while allowing the user to customize the position, number, and size of armor plates they wish to use. Further, multiple modular body harnesses may be used, depending on the amount of coverage needed for a particular task.

As used herein, the term "chest rig" is used to describe personal load carrying equipment which is often worn on the chest, torso, and/or abdomen. The chest rig which is used with the modular body harness described herein can be altered and may perform various functions as is known in the arts.

The modular body harness includes a sheet having slots. A first set of hook and loop strips are attached horizontally to the bottom portion of the sheet using an adhesive. A second set of hook and loops strips are attached to the left side and the right side of the sheet above the first set of hook and loop strips. Self-gripping hook and loop strips are positioned through each of the slots on the sheet and are folded back onto themselves. Paracord is positioned through a portion of the self-gripping hook and loop strips and is then tied to create a circle (or continuous length of paracord).

It is to be understood that the specific measurements used below are provided by way of example and are not intended to limit the scope of the embodiments disclosed herein. The exemplary measurements serve to provide an exemplary embodiment of a functional modular body harness capable of providing the functions described in this disclosure.

In some embodiments, the sheet may be a thermoplastic material such as acrylic polyvinyl chloride (e.g., Kydex) sheet having a thickness of 0.08 inches. The sheet may be configured to be 9 inches wide by 11 inches tall, with the top corners cut at an angle to form a hexagon or other polygonal shape.

In some embodiments, the sheet may include seven slots each having a length of 1⅛ inches and ⅛ inch width. The slots are positioned ½ inch from the edge of the sheet.

In some embodiments, the first set of hook and loop strips include two strips of hook and loop tape each being 2 inches wide and 9 inches long.

In some embodiments, the second set of hook and loop strips include two strips of hook and loop tape each being 2 inches wide and 4½ inches long.

In some embodiments, the self-gripping hook and loop strips include seven strips which are each 8 inches long.

In some embodiments, the paracord is 20 inches long to allow the paracord to connect to itself.

During use, the bottom self-gripping hook and loop strip is opened, and the body armor is inserted from the bottom to the top. The bottom self-gripping hook and loop strip is then fed around the paracord and reattached to itself. Each additional self-gripping hook and loop tape is then adjusted and tightened around the armor plate until it is securely fastened to the sheet. The armor plate is then ready for attachment to a chest rig via the first and second sets of hook and loop strips as well as the horizontal self-gripping hook and loop tape which is wrapped around the shoulder straps of the chest rig to further secure the chest rig to the sheet.

To construct a plate carrier using the modular body harness, the shoulders straps of the chest rig are connected to two modular body harness assemblies, such that each is attached to an armor plate. The side straps are then used to secure the plate carrier to the user.

FIG. 1 illustrates the front side 100 of the modular body harness 101 including a sheet 103 to provide a mounting surface 105 for various accessories (e.g., body armor plates, etc.) which can be attached to the modular body harness. The sheet 103 includes a plurality of slots 10107*a*, 107*b*, 107*c*, 107*d*, 107*e*, 107*f*, 107*g* which are positioned through the surface of the sheet 103. The slots 107*a*, 107*b*, 107*c*, 107*d*, 107*e*, 107*f*, 107*g* enable the insertion and retention of various hook and loop strips. A first set of hook and loop strips 109,110 are each attached to a bottom portion 111 of the sheet 103 using an adhesive. A second set of hook and loop strips 113,114 are attached to the left side 115 and the right side 117 of the sheet 103 using an adhesive above the first set of hook and loop strip 109,110. Self-gripping hook and loop strips 119*a*, 119*b*, 119*c*, 119*d*, 119*e*, 119*f*, 119*g* are positioned through one of the slots 107*a*, 107*b*, 107*c*, 107*d*, 107*e*, 107*f*, 107*g* and attached to themselves via the hook and loop attachment mechanism, such that the self-gripping hook and loop strips 119*a*, 119*b*, 119*c*, 119*d*, 119*e*, 119*f*, 119*g* loop around the edge 121 of the sheet 103.

Figure 2:
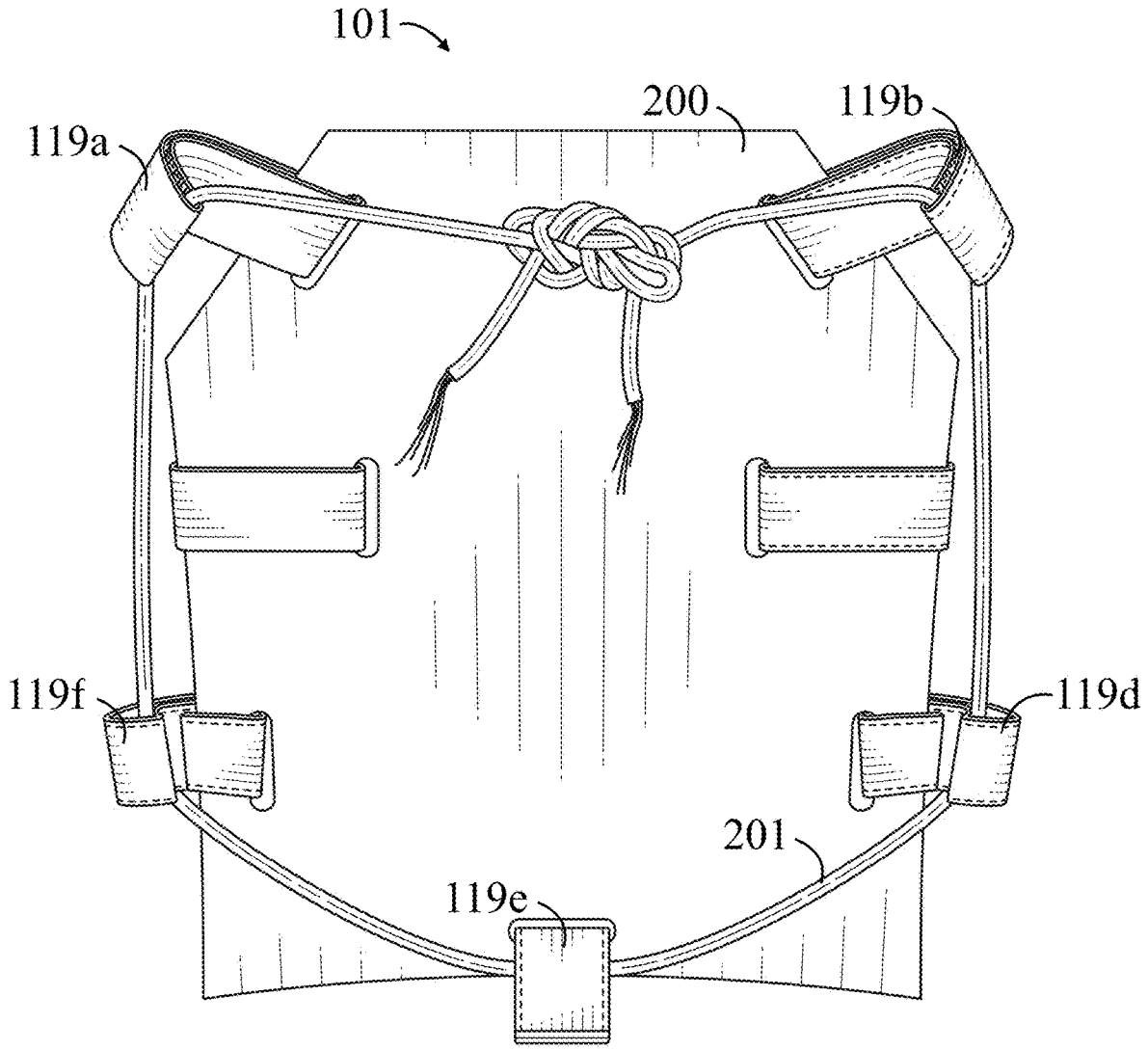
FIG. 2 illustrates a perspective view of the rear side of the modular body harness, according to some embodiments.

FIG. 2 illustrates the rear side 200 of the modular body harness 101. A paracord 201 (i.e., parachute cord) is positioned through a portion of the self-gripping hook and loop strips (such as 119*a*, 119*b*, 119*d*, 119*e*, and 119*f*) and is then tied or otherwise connected to itself to create a continuous length of paracord 201.

Figure 3:
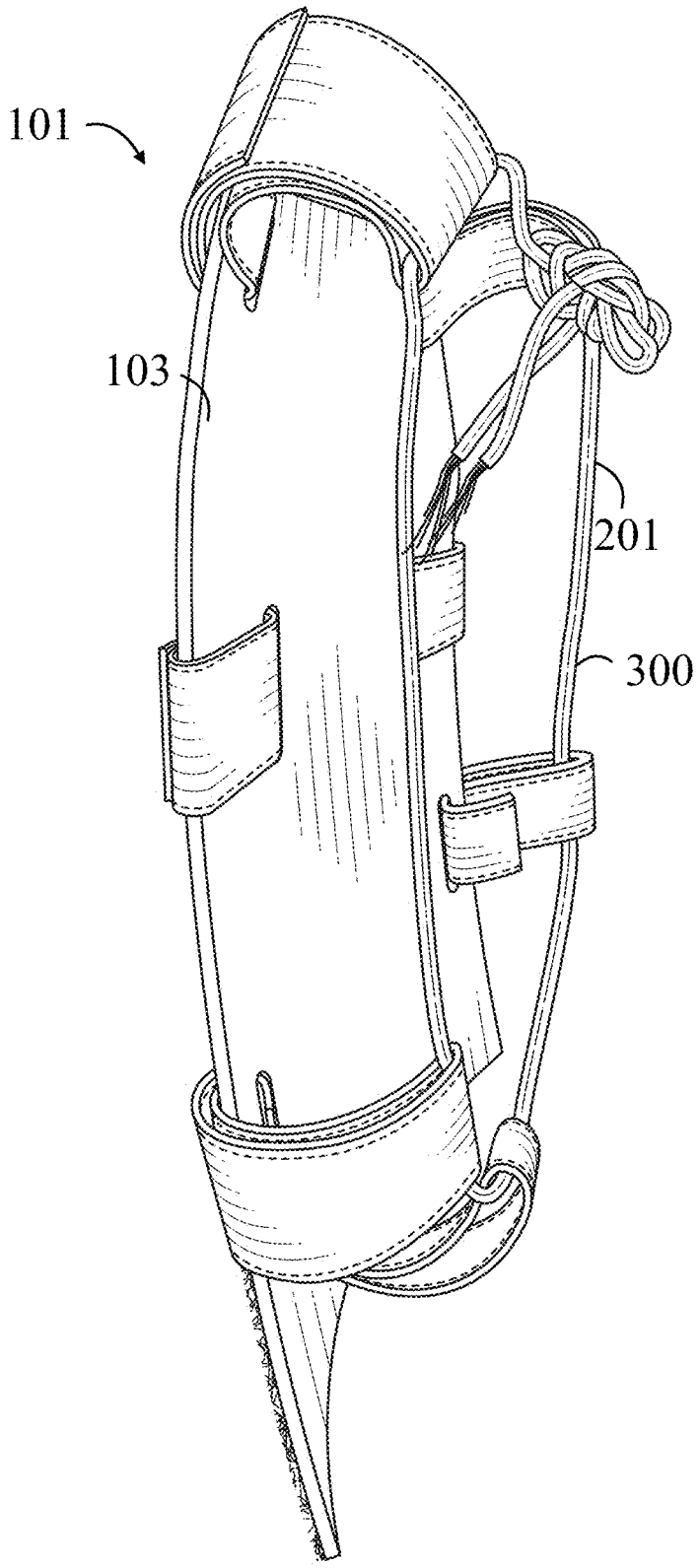
FIG. 3 illustrates a side elevation view of the modular body harness, according to some embodiments.

FIG. 3 illustrates the modular body harness 101. The paracord 201 when fed through the self-gripping hook and loop strips forms a mount 300 which enables the integration of a body armor plate or other item. The paracord 201 securely retains the item between itself and the sheet 103 to allow the user to wear the item around their torso.

Figure 4A:
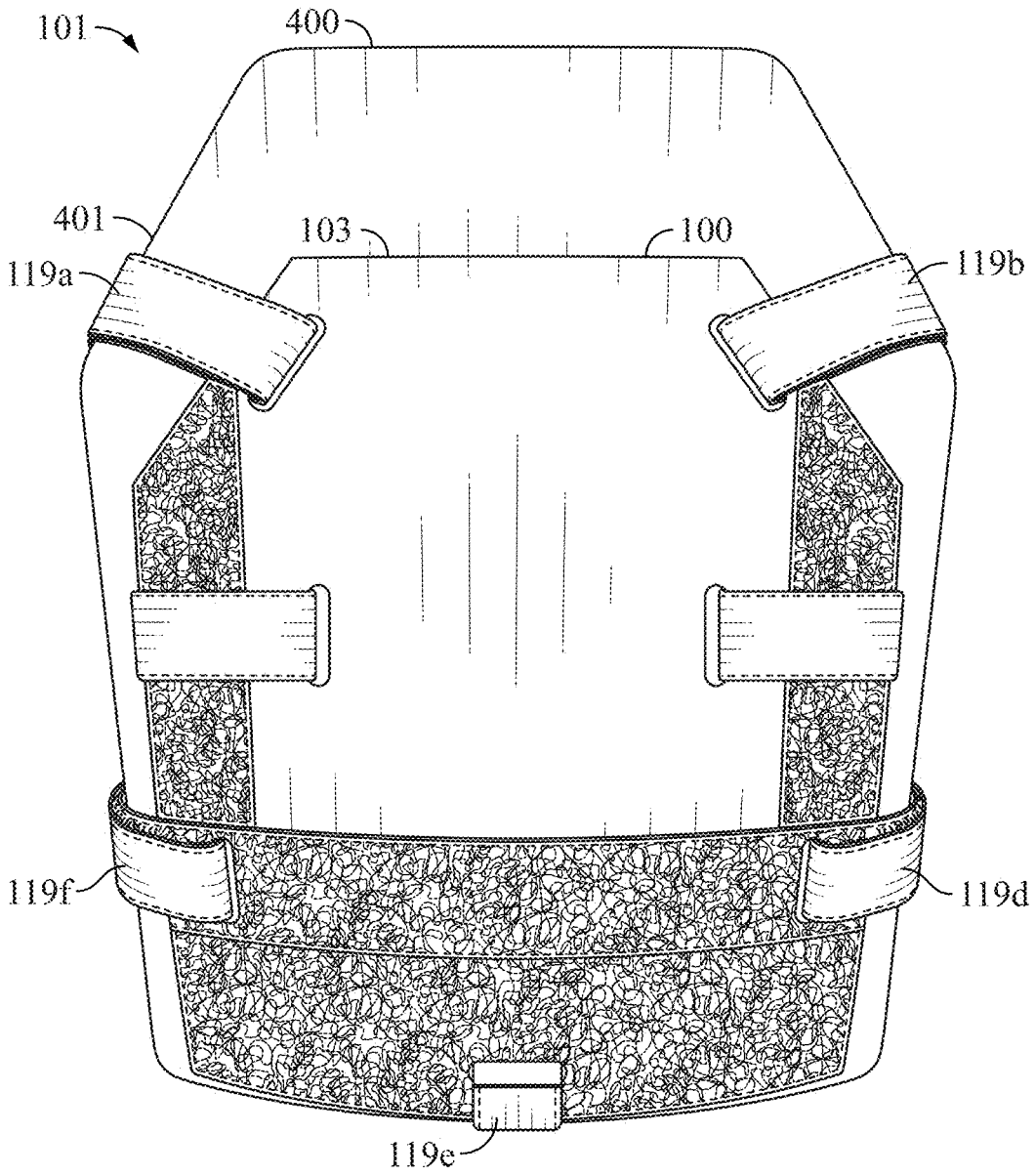
FIG. 4A illustrates a perspective view of the front side of the modular body harness having an attached armor plate, according to some embodiments.
Figure 4B:
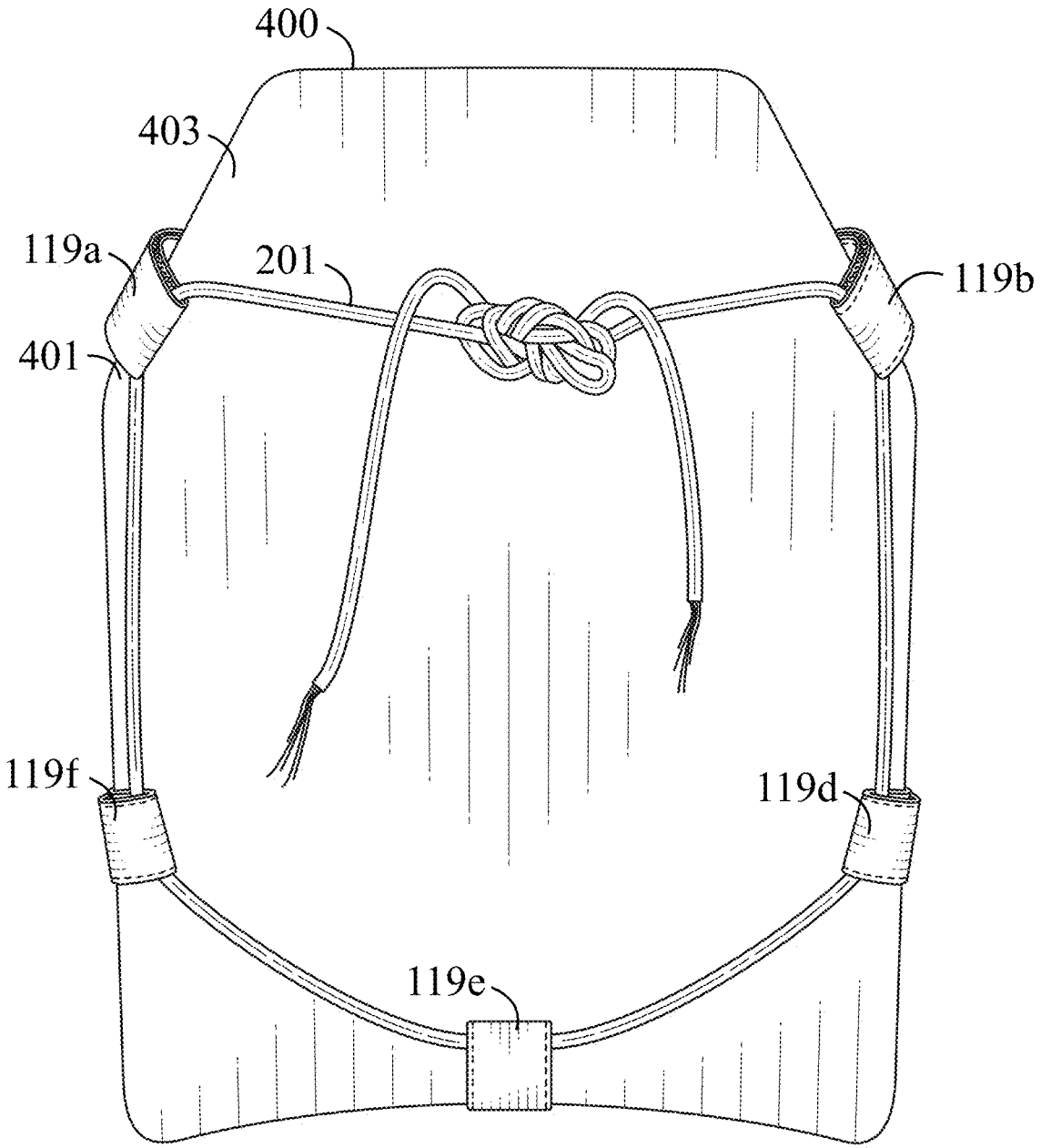
FIG. 4B illustrates a perspective view of the front side of the modular body harness having an attached armor plate, according to some embodiments.

FIG. 4A illustrates the front side 100 modular body harness 101 having an attached armor plate 400 which is securely held between the sheet 103 and the paracord 201 (see FIG. 4B). The modular assembly allows for various sizes and configurations of armor plates 400 to be connected to the modular body harness 101 such that the armor plate 400 is positioned between the back side of the sheet 103 and the user's body. Multiple armor plates can be worn by using additional modular body harness assemblies. FIG. 4B illustrates the rear side modular body harness 101 having the armor plate 400 connected between the sheet (see FIG. 4A) and paracord 201. As shown collectively in FIGS. 4A and 4B, self-gripping hook and look strips 119*a*, 119*b*, 119*d*, 119*e*, and 119*f* extend around the edge 401 of the armor plate such that the paracord 201 is positioned on the rear side 403 of the armor plate 400.

Figure 5:
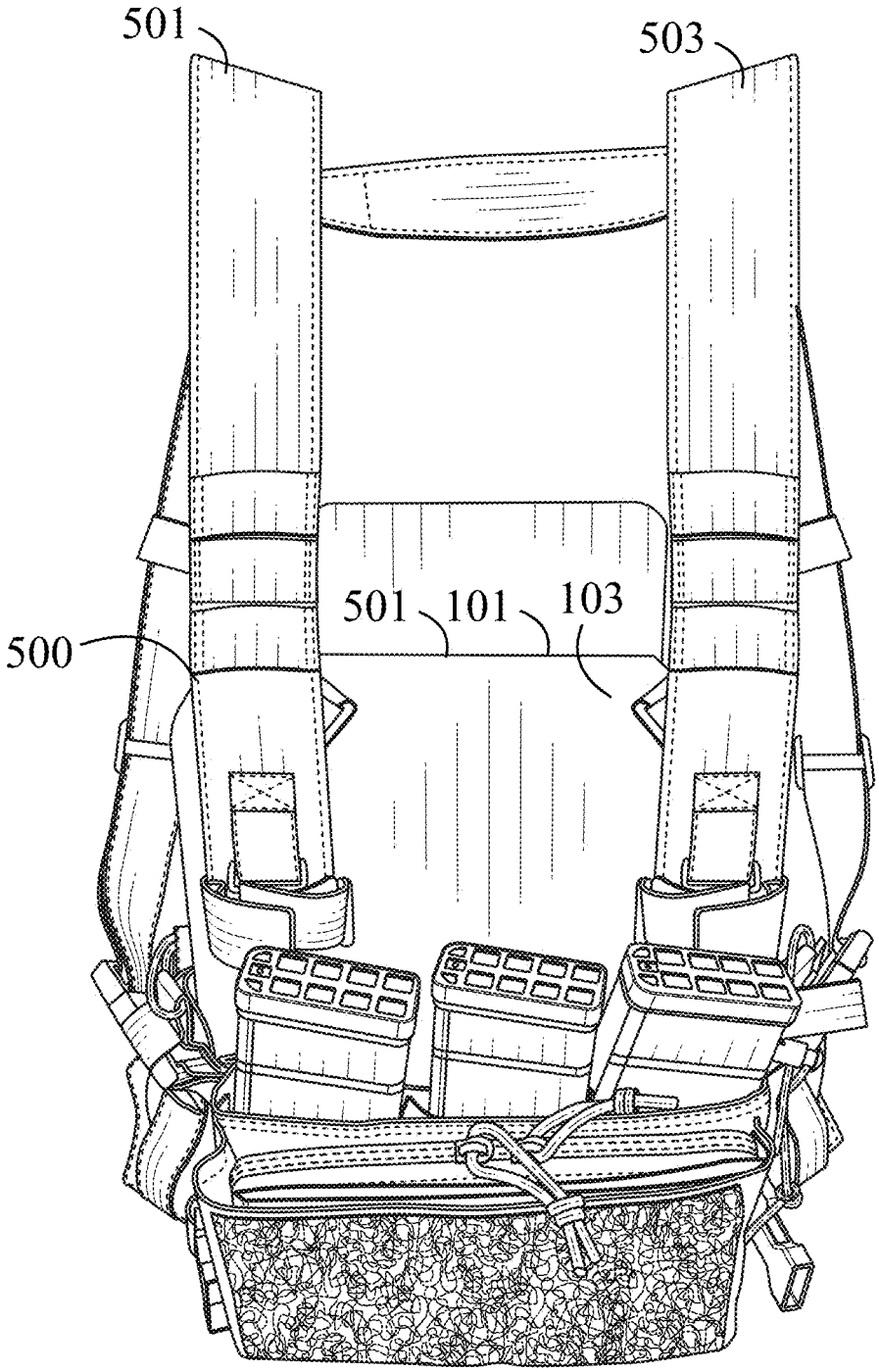
FIG. 5 illustrates a perspective view of a chest rig with the modular body harness attached thereto, according to some embodiments.
Figure 6:
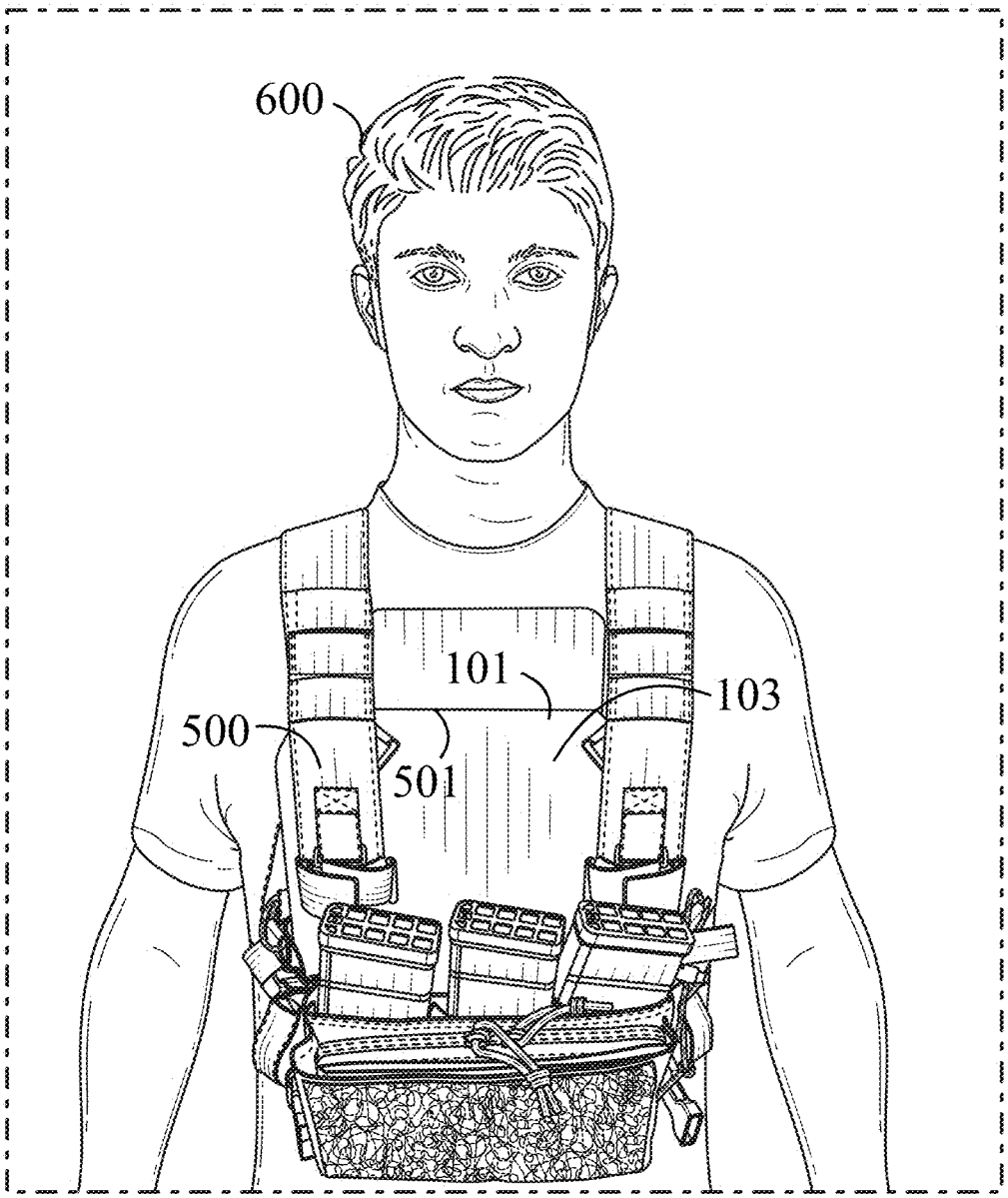
FIG. 6 illustrates a perspective view of a user wearing the chest rig with the modular body harness attached thereto, according to some embodiments.

FIG. 5 illustrates a chest rig 500 being used with the modular body harness 101. The chest rig can be any item which may commonly be used for tactical situations. The chest rig includes shoulder straps 501,503 and various pockets which can carry firearm magazines, tools, weapons, etc. FIG. 6 illustrates a user 600 wearing a chest rig 500 with the modular body harness 101 attached thereto. As described above and in further reference to FIGS. 5 and 6, the bottom self-gripping hook and loop strips are opened (such as by disengaging the hook and loop attachment mechanism, and the body armor plate 400 is inserted from the bottom portion 111 (see FIG. 1) to the top portion 501. The bottom self-gripping hook and loop strips are then fed around the paracord 201 and reattached to themselves. Each additional self-gripping hook and loop strip is then adjusted and tightened around the armor plate 400 until it is securely fastened to the sheet. The armor plate is then ready for attachment to a chest rig 500 via the first and second sets of hook and loop strips as well as the horizontal self-gripping hook and loop tape which is wrapped around the shoulder straps 501,503 of the chest rig 500 to further secure the chest rig 500 to the sheet 103. The bottom 505 of the chest rig 500 will attach to the first set of hook and loop strips 109,110 (see FIG. 1) such that the chest rig 500 is secured to the modular body harness 101, thus reducing bouncing or other unwanted movement. Similarly, the second set of hook and loop strips 113,114 may be used to further secure the chest rig 500.

Unless otherwise defined, all technical and scientific terms used herein have the same meaning as commonly understood by one of ordinary skill in the art to which this invention belongs. All publications, patent applications, patents, and other references mentioned herein are incorporated by reference in their entirety to the extent allowed by applicable law and regulations. The systems and methods described herein may be embodied in other specific forms without departing from the spirit or essential attributes thereof, and it is therefore desired that the present embodiment be considered in all respects as illustrative and not restrictive. Any headings utilized within the description are for convenience only and have no legal or limiting effect.

Many different embodiments have been disclosed herein, in connection with the above description and the drawings. It will be understood that it would be unduly repetitious and obfuscating to literally describe and illustrate every combination and subcombination of these embodiments. Accordingly, all embodiments can be combined in any way and/or combination, and the present specification, including the drawings, shall be construed to constitute a complete written description of all combinations and subcombinations of the embodiments described herein, and of the manner and process of making and using them, and shall support claims to any such combination or subcombination.

The foregoing is provided for purposes of illustrating, explaining, and describing embodiments of this disclosure. Modifications and adaptations to these embodiments will be apparent to those skilled in the art and may be made without departing from the scope or spirit of this disclosure.

As used herein and in the appended claims, the singular forms "a", "an", and "the" include plural referents unless the context clearly dictates otherwise.

It should be noted that all features, elements, components, functions, and steps described with respect to any embodiment provided herein are intended to be freely combinable and substitutable with those from any other embodiment. If a certain feature, element, component, function, or step is described with respect to only one embodiment, then it should be understood that that feature, element, component, function, or step can be used with every other embodiment described herein unless explicitly stated otherwise. This paragraph therefore serves as antecedent basis and written support for the introduction of claims, at any time, that combine features, elements, components, functions, and steps from different embodiments, or that substitute features, elements, components, functions, and steps from one embodiment with those of another, even if the description does not explicitly state, in a particular instance, that such combinations or substitutions are possible. It is explicitly acknowledged that express recitation of every possible combination and substitution is overly burdensome, especially given that the permissibility of each and every such combination and substitution will be readily recognized by those of ordinary skill in the art.

In many instances entities are described herein as being coupled to other entities. It should be understood that the terms "coupled" and "connected" (or any of their forms) are used interchangeably herein and, in both cases, are generic to the direct coupling of two entities (without any non-negligible (e.g., parasitic intervening entities) and the indirect coupling of two entities (with one or more non-negligible intervening entities). Where entities are shown as being directly coupled together or described as coupled together without description of any intervening entity, it should be understood that those entities can be indirectly coupled together as well unless the context clearly dictates otherwise.

While the embodiments are susceptible to various modifications and alternative forms, specific examples thereof have been shown in the drawings and are herein described in detail. It should be understood, however, that these embodiments are not to be limited to the particular form disclosed, but to the contrary, these embodiments are to cover all modifications, equivalents, and alternatives falling within the spirit of the disclosure. Furthermore, any features, functions, steps, or elements of the embodiments may be recited in or added to the claims, as well as negative limitations that define the inventive scope of the claims by features, functions, steps, or elements that are not within that scope.

An equivalent substitution of two or more elements can be made for any one of the elements in the claims below or that a single element can be substituted for two or more elements in a claim. Although elements can be described above as acting in certain combinations and even initially claimed as such, it is to be expressly understood that one or more elements from a claimed combination can in some cases be excised from the combination and that the claimed combination can be directed to a subcombination or variation of a subcombination.

It will be appreciated by persons skilled in the art that the present embodiment is not limited to what has been particularly shown and described herein. A variety of modifications and variations are possible in light of the above teachings without departing from the following claims.

What is claimed is:

1. A modular body harness, comprising:

a sheet including a plurality of slots;

a first set of hook and loop strips positioned horizontally at a bottom portion of the sheet;

a second set of hook and loop strips positioned vertically above the first set of hook and loop strips;

a plurality of self-gripping hook and loop strips each engaged with one of the plurality of slots and attached to themselves; and a parachute cord extending through a portion of the plurality of self-gripping hook and loop strips.

2. The modular body harness of claim 1, wherein the sheet is constructed of acrylic polyvinyl chloride.

3. The modular body harness claim 2, wherein the sheet is constructed having a polygonal shape.

4. The modular body harness of claim 1, wherein the parachute cord enables the input of a body armor plate to be retained between the parachute cord and the sheet.

5. The modular body harness of claim 1, wherein the first set of hook and loop strips include a top strip and bottom strip.

6. The modular body harness of claim 1, wherein the second set of hook and loop strips include a left strip and a right strip.

7. The modular body harness of claim 1, wherein the modular body harness is used as a plate carrier via the attachment of the modular body harness to a chest rig.

8. The modular body harness of claim 7, wherein the sheet is attached to the chest rig via the first set of hook and loop strips and the second set of hook and loop strips.

9. The modular body harness of claim 8, wherein the self-gripping hook and loop strips are adjustable to secure the body armor plate to the sheet.

10. A modular body harness system for constructing a plate carrier, the system comprising:

a sheet including a plurality of slots;

a first set of hook and loop strips positioned horizontally at a bottom portion of the sheet;

a second set of hook and loop strips positioned vertically above the first set of hook and loop strips;

a plurality of self-gripping hook and loop strips each engaged with one of the plurality of slots and attached to themselves; and a parachute cord extending through a portion of the plurality of self-gripping hook and loop strips; and a body armor plate positioned between the parachute cord and the sheet.

11. The modular body harness system of claim 10, wherein the sheet is constructed of acrylic polyvinyl chloride.

12. The modular body harness system claim 11, wherein the sheet is constructed having a polygonal shape.

13. The modular body harness system of claim 12, wherein the first set of hook and loop strips include a top strip and bottom strip.

14. The modular body harness system of claim 13, wherein the second set of hook and loop strips include a left strip and a right strip.

15. The modular body harness system of claim 14, wherein the modular body harness is used as a plate carrier via the attachment of the modular body harness to a chest rig.

16. The modular body harness system of claim 15, wherein sheet is attached to the chest rig via the first set of hook and loop strips and the second set of hook and loop strips.

17. The modular body harness system of claim 16, wherein the self-gripping hook and loop strips are adjustable to secure the body armor plate to the sheet.

18. A modular body harness system, the system comprising:

a sheet including seven slots positioned around an edge of the sheet, each slot to receive one of a plurality of self-gripping hook and loop strips;

a parachute cord positioned through five of the slots to form a continuous length of parachute cord;

a first set of hook and loop strips positioned horizontally at a bottom portion of the sheet;

a second set of hook and loop strips positioned vertically above the first set of hook and loop strips;

a parachute cord extending through a portion of the plurality of self-gripping hook and loop strips; and a body armor plate positioned between the parachute cord and the sheet, wherein the first set of hook and look strips and the second set of hook and loop strips attach to a chest rig to enable a user to customize the configuration of a plate carrier.

19. The modular body harness system of claim 18, wherein the parachute cord and the sheet form a space allowing for the insertion of the body armor plate.

20. The modular body harness system of claim 19, wherein the self-gripping hook and loop strips are adjustable to securely retain the body armor plate.

* * * * *